US011181119B2

(12) United States Patent
Guo et al.

(10) Patent No.: US 11,181,119 B2
(45) Date of Patent: Nov. 23, 2021

(54) IMPELLER AND WATER PUMP HAVING THE SAME

(71) Applicant: Johnson Electric International AG, Murten (CH)

(72) Inventors: Chuanjiang Guo, Shenzhen (CN); Chuanhui Fang, Hong Kong (CN); Feng Xue, Shenzhen (CN); Hongguang Li, Shenzhen (CN); Shaopeng Mo, Shenzhen (CN); Guilin Li, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 105 days.

(21) Appl. No.: 16/386,064

(22) Filed: Apr. 16, 2019

(65) Prior Publication Data

US 2019/0323516 A1 Oct. 24, 2019

(30) Foreign Application Priority Data

Apr. 20, 2018 (CN) ..... 201810361097.7

(51) Int. Cl.

*F04D 29/22* (2006.01)
*F04D 29/24* (2006.01)
*F04D 1/00* (2006.01)

(52) U.S. Cl.

CPC ..... *F04D 29/2216* (2013.01); *F04D 1/00* (2013.01); *F04D 29/242* (2013.01); *F05D 2240/20* (2013.01); *F05D 2250/712* (2013.01)

(58) Field of Classification Search

CPC .. F04D 29/22; F04D 29/2205; F04D 29/2216; F04D 29/2222

See application file for complete search history.

(56) References Cited

U.S. PATENT DOCUMENTS 359,096 A * 3/1887 Richards ..... F04D 29/2266 415/106
3,663,117 A * 5/1972 Warren ..... C02F 3/205 415/116
3,964,840 A * 6/1976 Kamelmacher ..... F04D 29/24 416/183

(Continued)

FOREIGN PATENT DOCUMENTS

CN 105697414 A * 6/2016
CN 107035718 A * 8/2017 ..... F04D 9/00

(Continued)

*Primary Examiner* — Igor Kershteyn
*Assistant Examiner* — Topaz L. Elliott
(74) *Attorney, Agent, or Firm* — Millman IP Inc.

(57) ABSTRACT

An impeller includes a base plate, a hub protruding from the base plate, and a number of blades connected to the base plate and extending from a lateral surface of the hub toward an edge of the base plate. Opposite sides of each of the blades are a working surface and a non-working surface. The base plate is divided into a plurality of sub-plates by the plurality of blades. Each of the sub-plates is located between two adjacent blades and connected to the non-working surface of one of the two adjacent blades and the working surface of the other one of the two adjacent blades. A distance from an edge of each of the sub-plates to a center of rotation of the impeller is varied.

15 Claims, 12 Drawing Sheets

(56) References Cited

U.S. PATENT DOCUMENTS

| | | | | |
|---|---|---|---|---|
| 4,755,105 | A * | 7/1988 | Blakeslee | F04D 29/281 415/141 |
| 5,605,444 | A * | 2/1997 | Paton | F04D 29/2277 416/183 |
| 9,371,834 | B2 * | 6/2016 | Daugaard | F04D 7/045 |
| 10,286,167 | B2 * | 5/2019 | Bothma | G01F 1/0755 |
| 10,578,118 | B2 * | 3/2020 | Nibu | A61M 16/0875 |
| 10,626,880 | B2 * | 4/2020 | Obuchi | F04D 29/2222 |
| 10,677,258 | B2 * | 6/2020 | Tamaoka | F04D 17/16 |
| 2006/0210394 | A1 * | 9/2006 | Nakano | F04D 29/2255 415/206 |
| 2013/0004321 | A1 * | 1/2013 | Yokoyama | F01D 1/28 416/223 R |
| 2016/0290352 | A1 * | 10/2016 | Hayamitsu | F04D 29/4233 |
| 2017/0198722 | A1 * | 7/2017 | Nuhn | F04D 1/06 |
| 2017/0260992 | A1 * | 9/2017 | Obuchi | F04D 29/2222 |
| 2017/0370379 | A1 * | 12/2017 | Wilfley | F04D 29/30 |
| 2019/0345954 | A1 * | 11/2019 | Wessels | F04D 29/2205 |
| 2019/0350232 | A1 * | 11/2019 | Assing | F04D 29/588 |

FOREIGN PATENT DOCUMENTS

| | | | | |
|---|---|---|---|---|
| DE | 2907432 | A1 * | 9/1980 | A47L 15/4225 |
| FR | 2618857 | A3 * | 2/1989 | F04D 9/00 |
| JP | 58035295 | A * | 3/1983 | F04D 29/2222 |

* cited by examiner

IMPELLER AND WATER PUMP HAVING THE SAME

CROSS REFERENCE TO RELATED APPLICATIONS

This non-provisional patent application claims priority under 35 U.S.C. § 119(a) from Patent Application No. 201810361097.7 filed in the People's Republic of China on Apr. 20, 2018.

FIELD

The present disclosure relates to impellers, and particularly to a centrifugal impeller and a water pump having the same.

BACKGROUND

An impeller of some conventional water pumps includes a circular wheel and a number of arc-shaped blades spaced apart from one another and connected to the circular wheel. The impeller has the disadvantages of large axial force, low hydraulic efficiency, and large starting torque. Since the gap between the wheel and the inner wall of a housing of the water pumps is small, the impeller may tend to be stuck by foreign objects during operation.

SUMMARY

An impeller includes a base plate, a hub protruding from the base plate, and a number of blades connected to the base plate and extending from a lateral surface of the hub toward an edge of the base plate. Opposite sides of each of the blades are a working surface and a non-working surface. The base plate is divided into a plurality of sub-plates by the plurality of blades. Each of the sub-plates is located between two adjacent blades and connected to the non-working surface of one of the two adjacent blades and the working surface of the other one of the two adjacent blades. A distance from an edge of each of the sub-plates to a center of rotation of the impeller is varied.

DETAILED DESCRIPTION

Embodiments of the present disclosure will be described in detail in conjunction with the drawings. It should be noted that the figures are illustrative rather than limiting. The figures are not drawn to scale, do not illustrate every aspect of the described embodiments, and do not limit the scope of the present disclosure.

Figure 1:
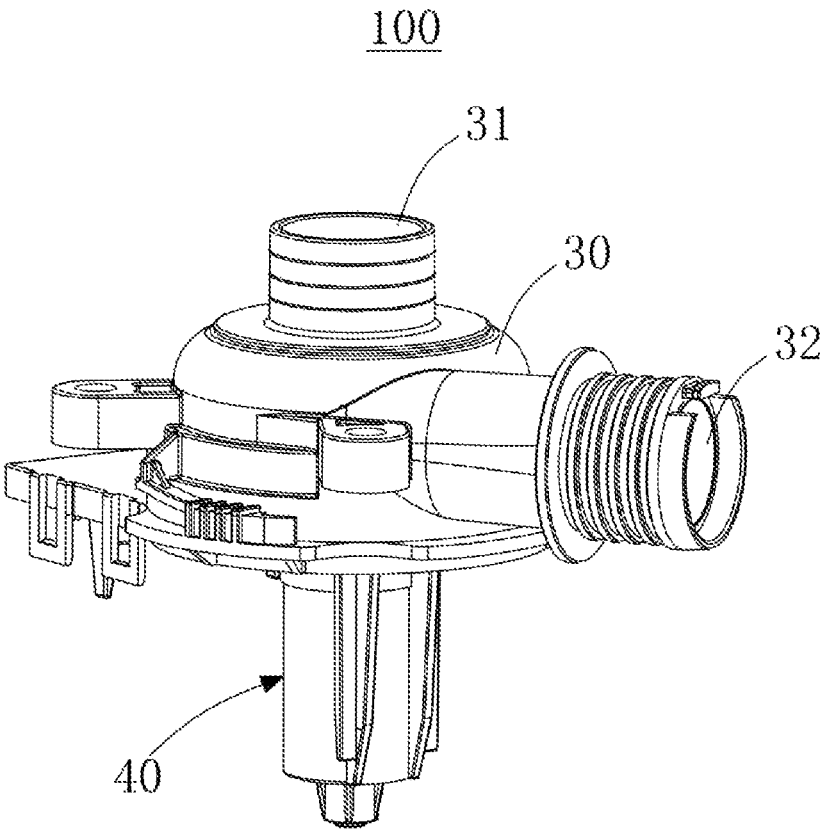
FIG. 1 is an isometric view of a pump according to an embodiment.

Referring to FIG. 1, a water pump 100 according to an embodiment can be applied to a device such as a washing machine or a dishwasher that requires a water pump. The water pump 100 includes a housing 30, a motor 40 connected to the housing 30, and an impeller 10 (see FIG. 2) received in the housing 30 and driven by the motor 40. The impeller 10 is a centrifugal impeller. While the water pump 100 is in operation, the motor 40 drives the impeller 10 to rotate, causing external fluid to enter from an inlet 31 of the housing 30 and flow out of an outlet 32 of the housing 30.

Figure 2:
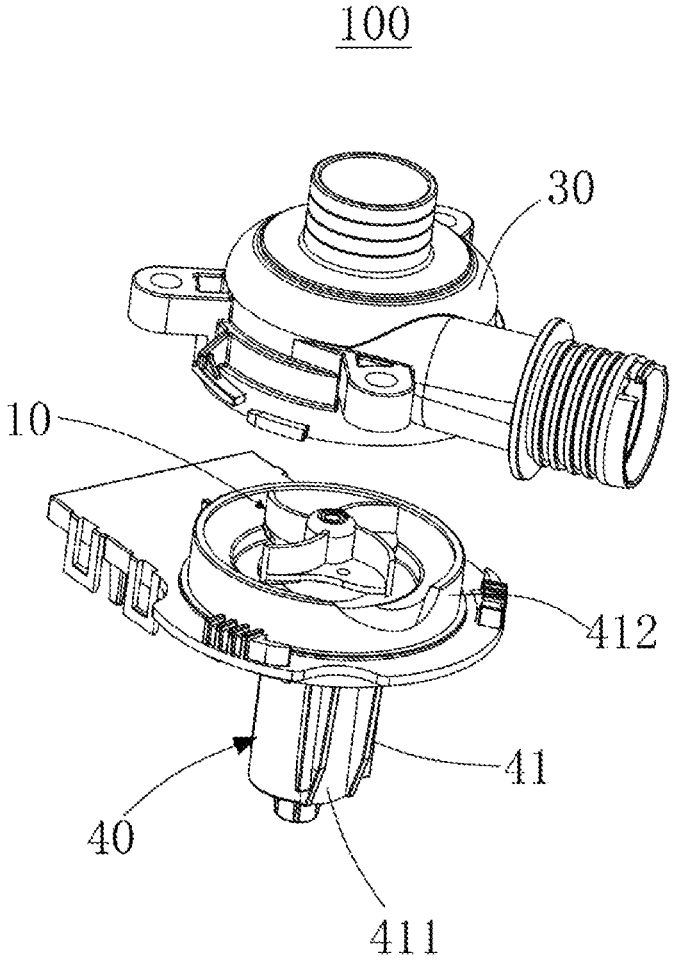
FIG. 2 is an isometric exploded view of the pump of FIG. 1.

Referring to FIG. 2, the motor 40 includes a motor casing 41. The motor casing 41 includes a cylindrical body 411 that is open at one end and a connecting portion 412 that is formed at the open end of the body 411. The connecting portion 412 includes a bottom portion extending in a radial direction of the body 411 and a side wall extending from the bottom portion in a direction away from the body 411. One end of the motor shaft (not shown) protrudes out of the open end of the main body 411. One end of the housing 30 is arranged around the side wall of the connecting portion 412. The impeller 10 is received in a space defined by the connecting portion 412 and the housing 30, and is fixed to the motor shaft.

Referring to FIGS. 3-6, the impeller 10 includes a base plate 11, a hub 12 and a number of blades 13. The hub 12 is formed at the center of the base plate 11, and protrudes from one side of the base plate 11. The hub 12 defines a shaft hole for the motor shaft of the motor 40 to be inserted, thereby enabling the impeller 10 to be fixed to the motor shaft. The blades 13 extend from the lateral surface of the hub 12 toward the outer edge of the base plate 11, and the bottom end of each of the blades 13 is connected to the base plate 11. The blades 13 are arranged at even intervals along the circumferential direction of the base plate 11. The blade 13 has an arcuate shape, the opposite sides of each of the blades 13 are a working surface 131 and a non-working surface 132, the working surface 131 is a convex surface and the non-working surface 132 is a concave surface.

The base plate 11 is divided into a number of sub-plates 14 by the blades 13. The number of the sub-plates 14 is equal to the number of the blades 13. Each of the blades 13 includes a radially inner end 136 and a radially outer end 133 that are coupled to the lateral surface of the hub 12, and the radially outer end 133 partially extends through the base plate 11 (see FIG. 5). In the embodiment, the number of the blades 13 is four, and the number of the sub-plates 14 is four. Each of the sub-plates 14 defines a through hole 141 which serves as a balance hole on the one hand to reduce the axial force of the impeller and, on the other hand, as an auxiliary positioning hole for mounting a bearing seat below the impeller.

Each of the sub-plates 14 is located between two adjacent blades 13. For convenience of description, the following description will be made by taking two adjacent blades 13*a* and 13*b*, and the sub-plate 14 therebetween as an example. The sub-plate 14 is connected to the non-working surface 132 of the blade 13*a* and the working surface 131 of the bade 13*b*.

Figure 3:
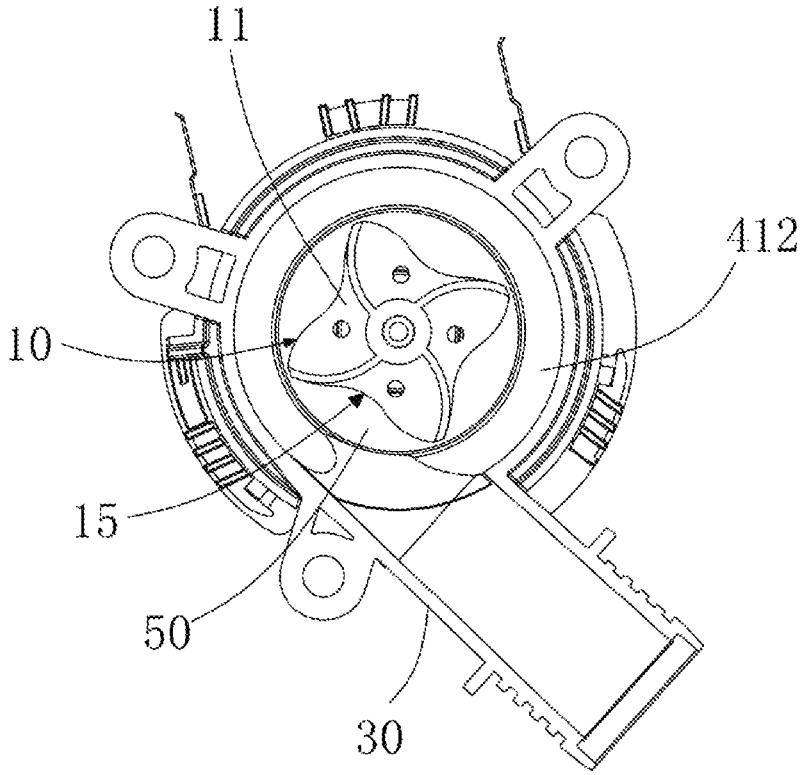
FIG. 3 is cross-sectional view of the pump of FIG. 1.
Figure 4:
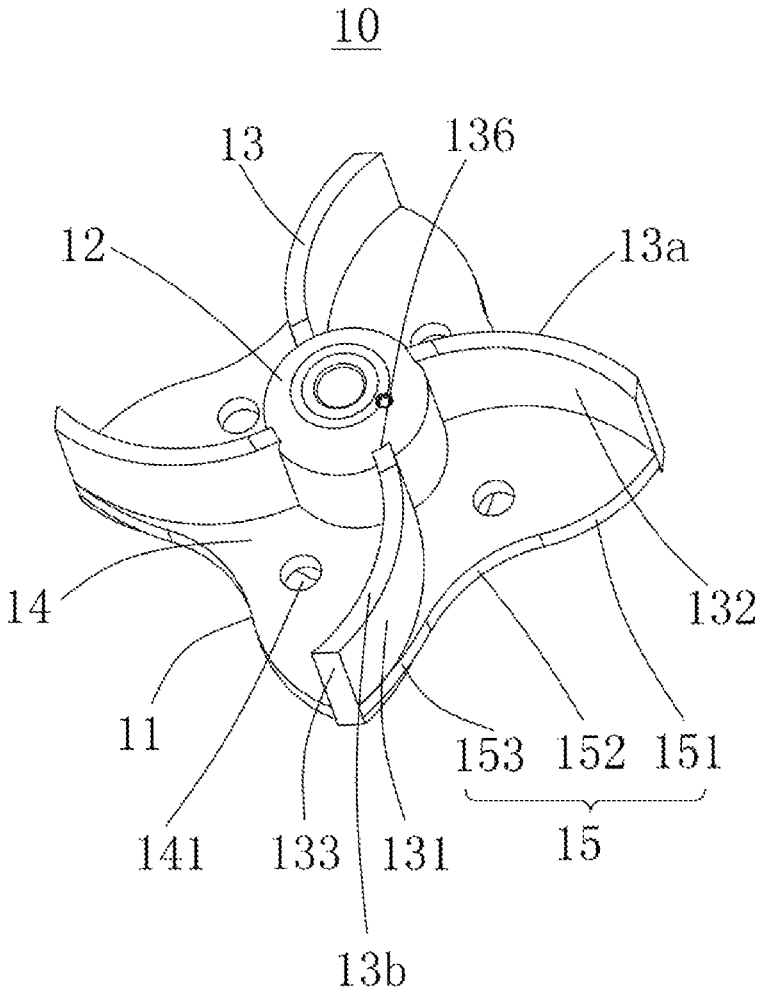
FIG. 4 is an isometric view of an impeller of the pump of FIG. 1.

The distance from an edge 15 of the sub-plate 14 to a center O of rotation of the impeller 10 is varied such that there is a space 50 of varying width between the edge 15 and the inner wall of the connecting portion 412 (see FIG. 3). An advantage of such configuration is that risk of the impeller 10 being stuck by foreign objects is reduced. In the embodiment, the distance from the edge 15 to the center O of rotation of the impeller 10 is gradually reduced and then gradually increased, along a circumferential direction starting from the non-working surface 132 of the blade 13*a* toward the working surface 131 of the blade 13*b*. That is, compared with opposite ends, the middle portion of the edge 15 closer to the hub 12, which is advantageous for reducing the axial force and the starting torque of the impeller 10.

In one embodiment, distance between an end of each sub-plate 14 away from the hub 12 and the center O of rotation of the impeller is the same. For example, the distance D1 between an end of the blade 13*a* and the center O of rotation of the impeller 10 is equal to the distance D2 between an end of the blade 13*b* and the center O of rotation of the impeller 10. The edge 15 of the sub-plate 14 is tangent to, at an end, the working surface 131 of the blade 13*b* so as to maintain the hydraulic efficiency of the impeller 10. The other end of the edge 15 and the non-working surface 132 of the blade 13*a* form an angle A greater than 0 degrees to prevent fluid backflow during operation of the impeller 10. The angle A is equal to or less than a supplementary angle of an outlet blade angle B of the non-working surface 132.

In one embodiment, the edge 15 of the sub-plate 14 has a wave shape and includes three successively connected surfaces i.e. a first curved surface 151, a second curved surface 152, and a third curved surface 153. The first and third curved surfaces 151 and 153 are convex surfaces, and the second curved surface 152 is a concave surface. The first surface 151 and the non-working surface 132 of the blade 13*a* form the angle A. The third surface 153 is tangent to the working surface 131 of the blade 13*b* to maintain the hydraulic efficiency of the impeller 10 during operation. The second surface 152 is curved toward the hub 12 so as to provide a larger space 50 between the edge 15 and the inner wall of the connecting portion 412 at a substantially central portion of the edge 15.

Figure 5:
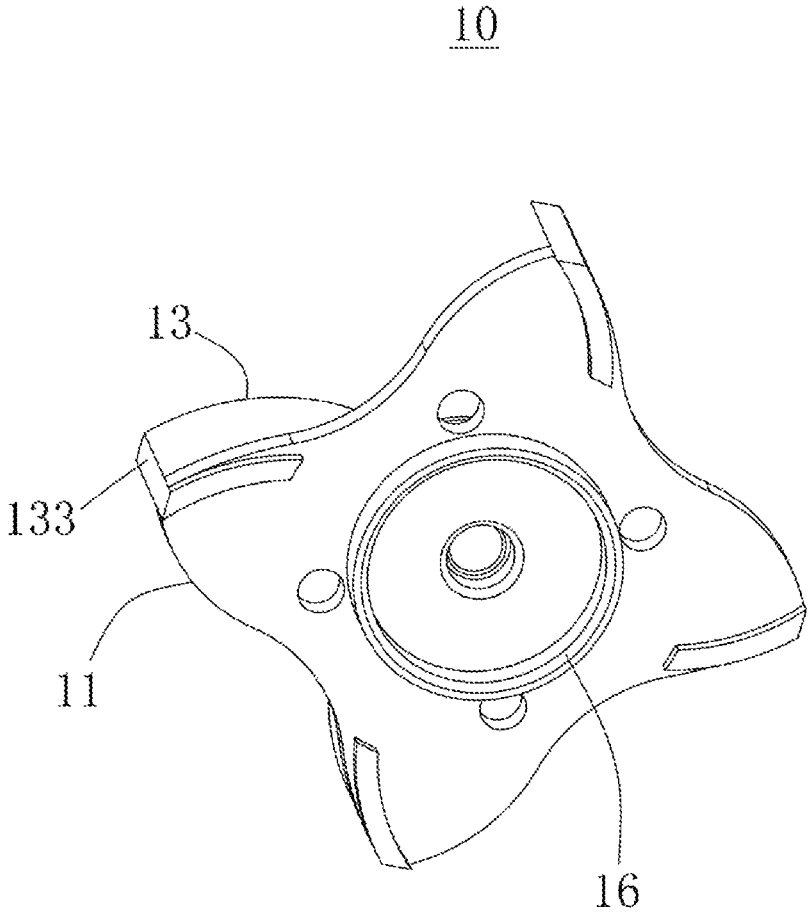
FIG. 5 is an isometric view of an impeller of the pump of FIG. 1, viewed from a different perspective.
Figure 6:
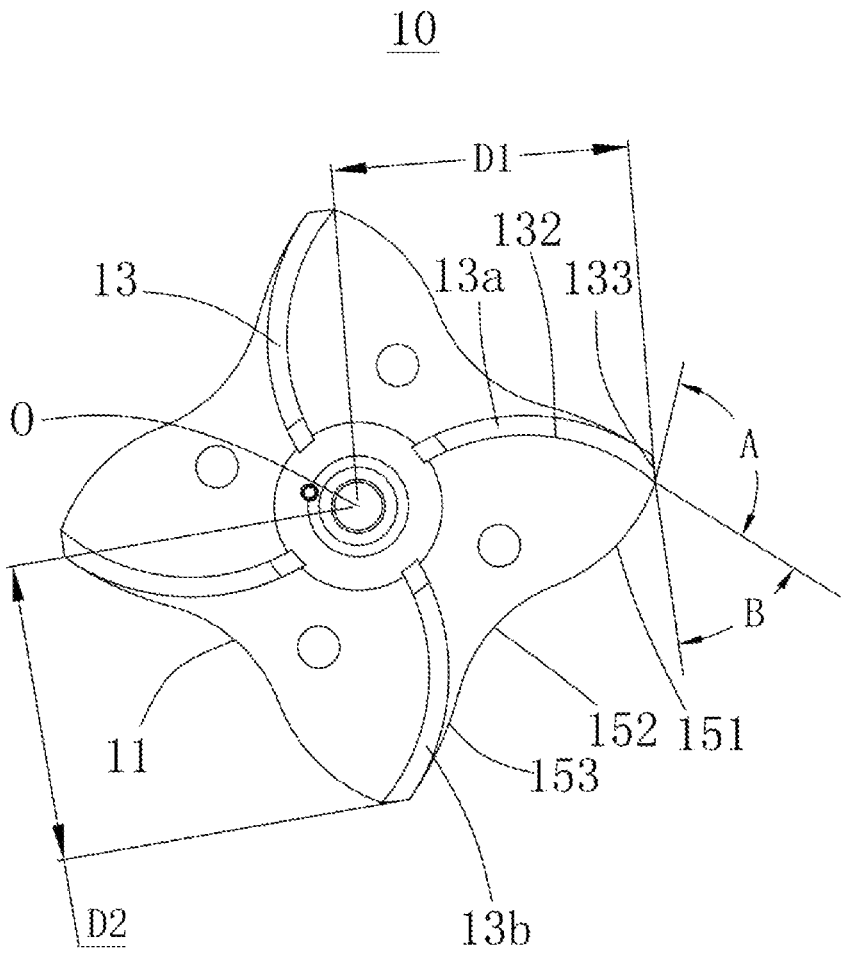
FIG. 6 is a top view of the impeller of FIG. 4.

In one embodiment, a smooth transition is made between the first surface 151 and the second surface 152, and between the second surface 152 and the third convex surface 153. As shown in FIG. 5, the side or bottom surface of the base plate 11 away from the hub 12 includes a ring portion 16 at a position under the hub 120. The ring portion 16 prevents the elongate foreign matter such as shoelaces, wool, etc. from being wound around the motor shaft to cause the motor to be stuck.

Figure 7:
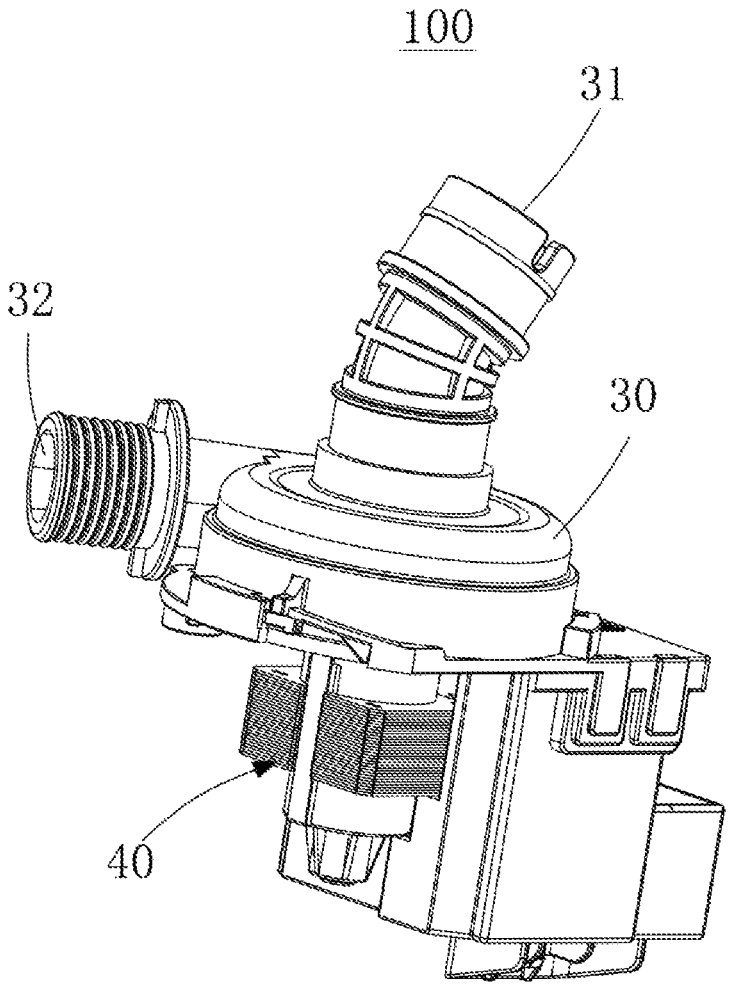
FIG. 7 is an isometric view of a pump according to another embodiment.
Figure 8:
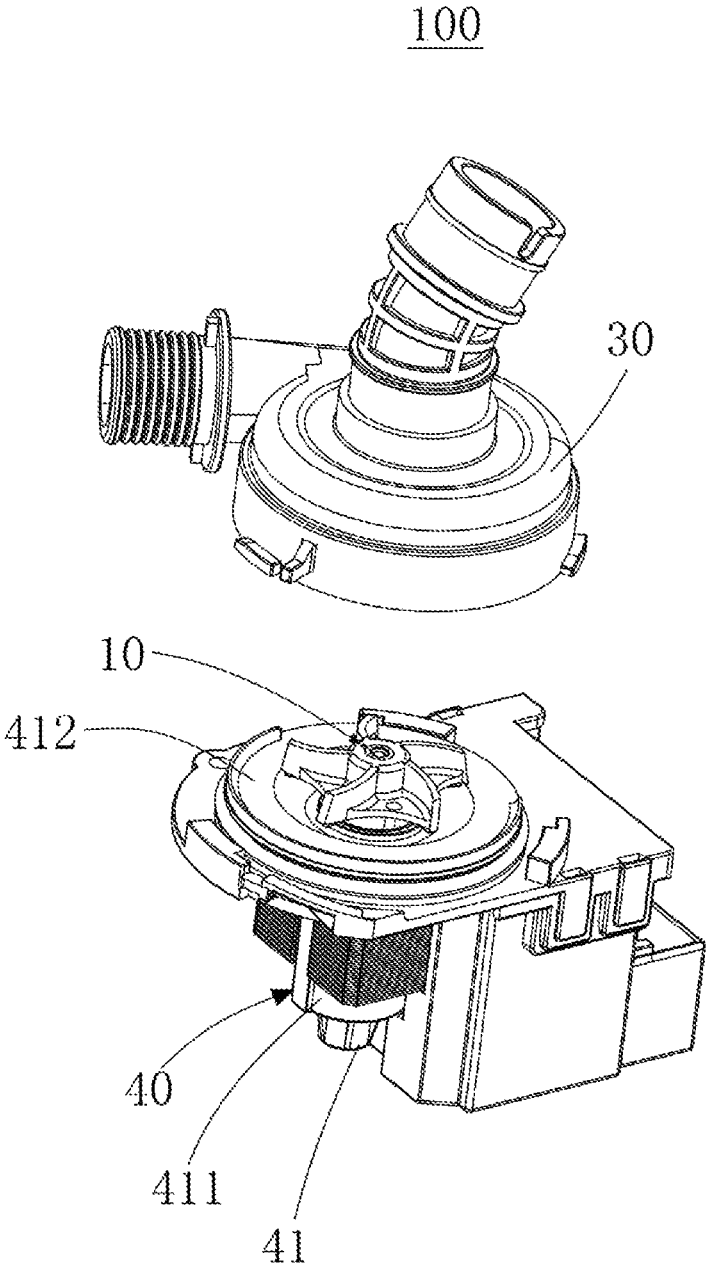
FIG. 8 is an isometric exploded view of the pump of FIG. 7.
Figure 9:
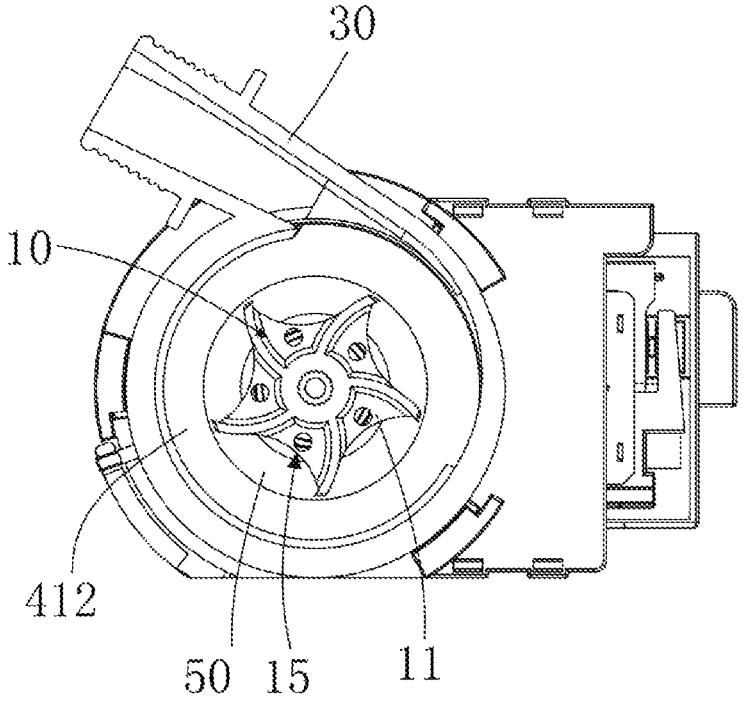
FIG. 9 is cross-sectional view of the pump of FIG. 7.
Figure 10:
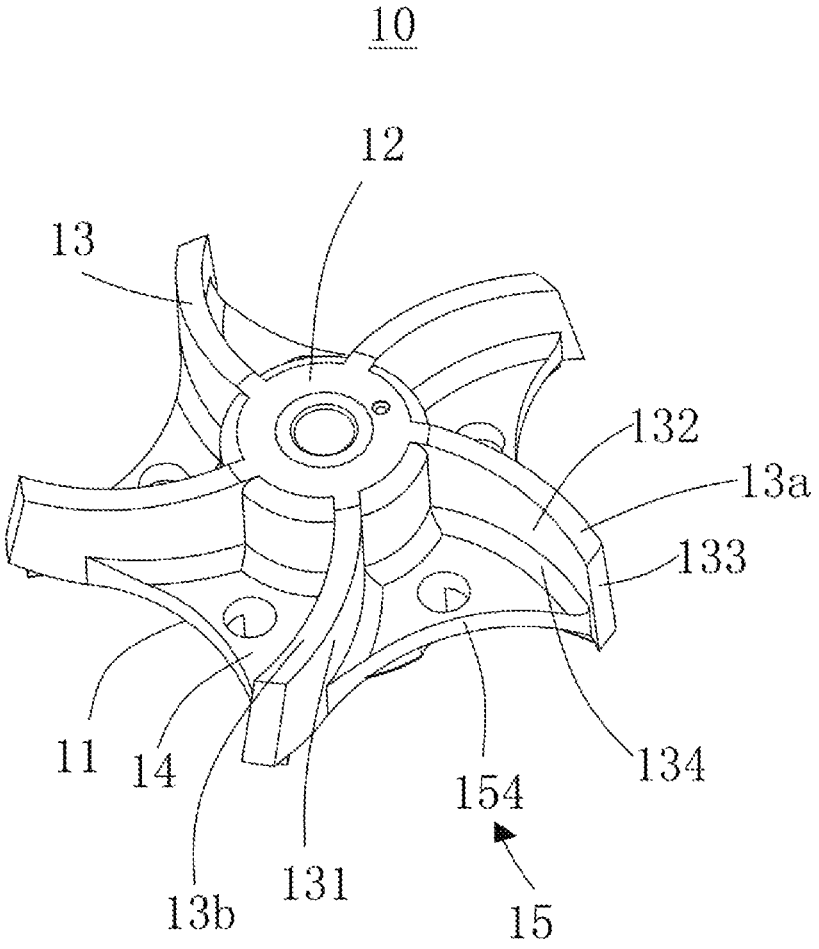
FIG. 10 is an isometric view of an impeller of the pump of FIG. 7.

Referring to FIGS. 7 and 8, a water pump 100 according to another embodiment is different from the above embodiment in that the structure of the impeller 10 is different.

Figure 12:
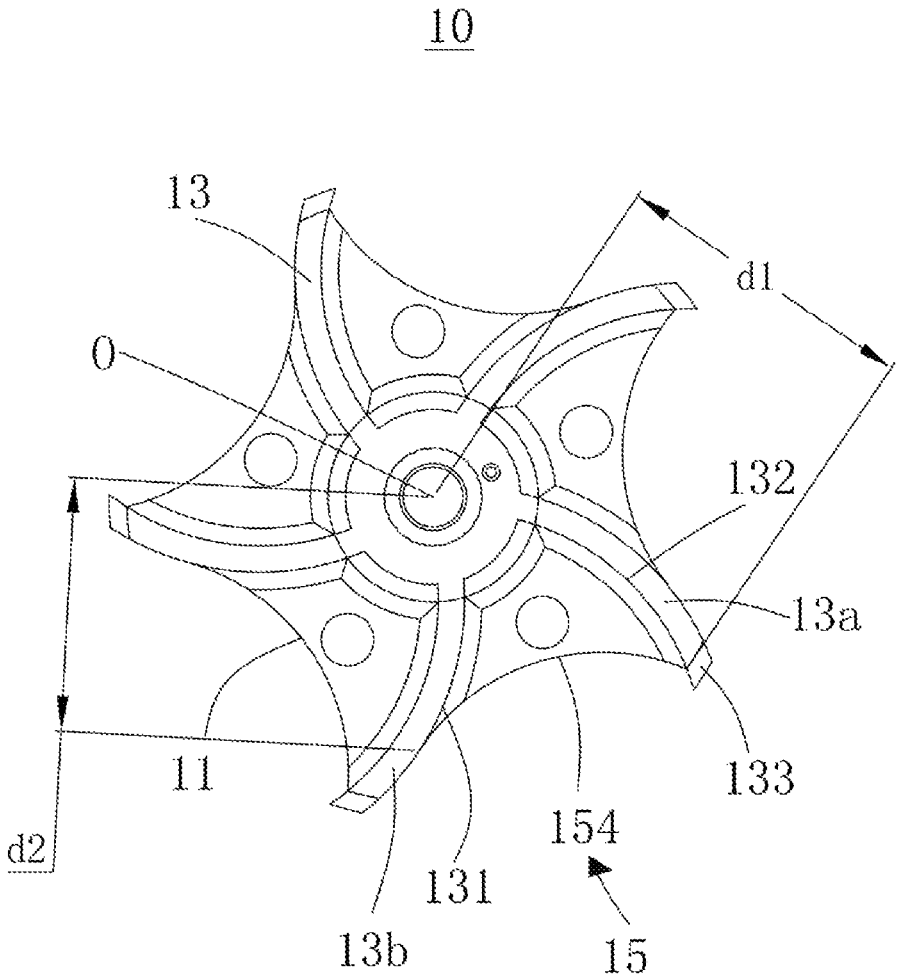
FIG. 12 is a top view of the impeller of FIG. 10.

Referring to FIGS. 7 12, a distance d1 from a joint where each sub-plate 14 is connected to the non-working surface 132 of the blade 13*a* to the center O of rotation of the impeller 10 is greater than a distance d2 from a joint where the sub-plate 14 is connected to the working surface 131 of the blade 13*b* to center O of rotation of the impeller 10.

In the embodiment, the edge 15 of each sub-plate 14 is a surface 154 curved toward the hub 12, resulting in a varying distance from the edge 15 to the center O of rotation of the impeller 10. A space 50 having a changing width is thus formed between the edge 15 and the inner wall of the connecting portion 412. With such configuration, from one end to the other, the distance from the edge 15 to the center O of rotation of the impeller 10 is gradually decreased and then increased. The surface 154 is tangent to, at an end, the working surface 131 of the blade 13*b* so as to maintain the hydraulic efficiency of the impeller 10. The other end of the surface 154 and the non-working surface 132 of the blade 13*a* form an angle A greater than 0 degrees. The joints where the working surface 131 and the non-working surface 132 of each blade 13 and the top side of the base plate 11 adjacent to the hub 12 are connected are rounded.

A bottom side of the base plate 11 away from the hub 12 includes a cylindrical wall 18. The bottom side of the base plate 11 further includes a number of reinforcing ribs 19. The reinforcing ribs 19 are spaced apart from each other along the circumferential direction of the cylindrical wall 18. Each reinforcing rib 19 is located under one blade 13. Radially outer ends of the reinforcing ribs 19 are respectively connected to radially outer ends of the blades 13.

Figure 11:
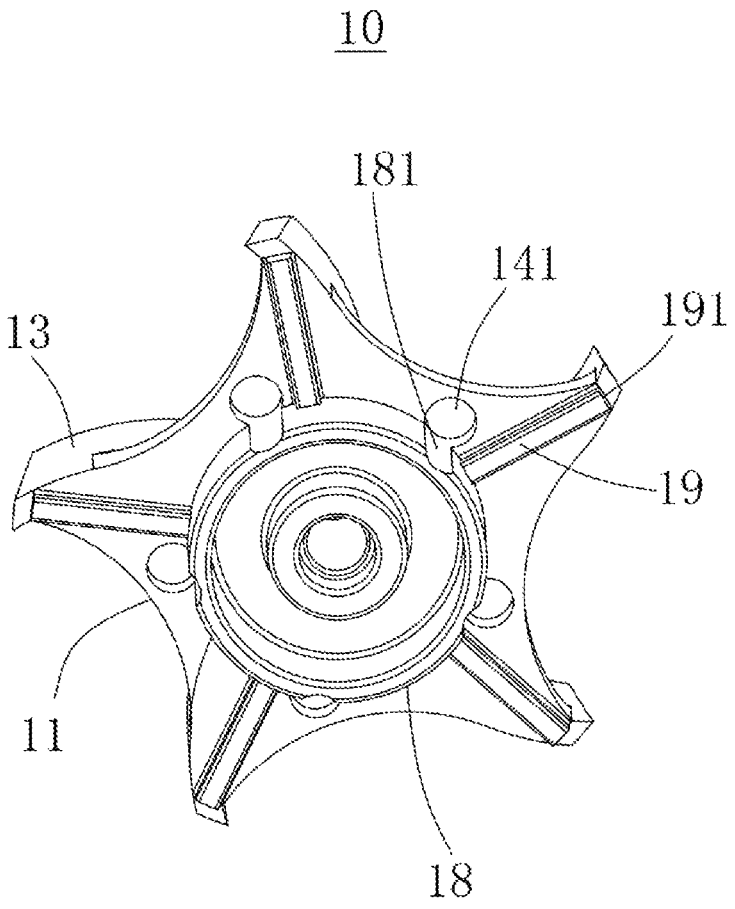
FIG. 11 is an isometric view of an impeller of the pump of FIG. 7, viewed from a different perspective.

The outer peripheral surface of the cylindrical wall 18 defines a number of grooves 181 (see FIG. 11) communicating with the through holes 141. The grooves 181 are used for mounting bearing holders.

In one embodiment, the number of the blades 13 is five, the number of the sub-plates 14 is five, and the number of the reinforcing ribs 19 is five. In the embodiment, each of the blades 13 penetrates the base plate 11, that is, each of the blades 13 includes two portions distributed on opposite sides of the base plate 11. The blade 13 and the base plate 11 are integrally formed as a single member.

The invention claimed is:

1. An impeller comprising:

a base plate;

a hub protruding from the base plate; and a plurality of blades connected to the base plate and extending from a lateral surface of the hub toward an edge of the base plate, opposite sides of each of the blades being a working surface and a non-working surface; each of the blades having an arcuate shape and comprising a radially inner end that is coupled to the lateral surface of the hub and a radially outer end, the working surface being a convex surface and the non-working surface being a concave surface;

wherein the base plate is divided into a plurality of sub-plates by the plurality of blades, each of the sub-plates is located between two adjacent blades and connected to the non-working surface of one of the two adjacent blades and the working surface of the other one of the two adjacent blades, and a distance from an edge of each of the sub-plates to a center of rotation of the impeller is varied, and the edge of each sub-plate has a wave shape and comprises a first curved surface, a second curved surface, and a third curved surface successively connected, the first and third curved surfaces are convex surfaces, and the second curved surface is a concave surface.

2. The impeller according to claim 1, wherein a bottom surface of the base plate away from the hub includes a ring portion at a position under the hub.

3. The impeller according to claim 1, wherein the distance from the edge of each of the sub-plates to the center of rotation of the impeller is gradually reduced and then gradually increased, along a circumferential direction starting from the non-working surface of one of the two adjacent blades toward the working surface of the other one of the two adjacent blades.

4. The impeller according to claim 1, wherein a distance between an end of each sub-plate away from the hub and the center of rotation of the impeller is the same.

5. The impeller according to claim 1, wherein a distance from a joint where each sub-plate is connected to the non-working surface of the one of the two adjacent blades to the center of rotation of the impeller is greater than a distance from a joint where the sub-plate is connected to the working surface of the other one of the two adjacent blades to the center of rotation of the impeller.

6. The impeller according to claim 1, wherein the edge of each sub-plate is tangent to the working surface of the other one of the two adjacent blades.

7. The impeller according to claim 6, wherein an angle is formed between the edge of each sub-plate and the non-working surface of the one of the two adjacent blades.

8. The impeller according to claim 7, wherein the angle is equal to or less than a supplementary angle of an outlet blade angle of the impeller.

9. The impeller according to claim 1, wherein a side of the base plate away from the hub comprises a plurality of reinforcing ribs.

10. The impeller according to claim 1, wherein a side of the base plate away from the hub comprises a plurality of reinforcing ribs, and radially outer ends of the reinforcing ribs are respectively connected to radially outer ends of the blades.

11. The impeller according to claim 1, wherein each of the sub-plates defines a through hole therein.

12. A pump comprising:

a housing;

a motor connected to the housing; and an impeller received in the housing and driven by the motor, the impeller comprising:

a base plate;

a hub protruding from the base plate; and a plurality of blades connected to the base plate and extending from a lateral surface of the hub toward an edge of the base plate, opposite sides of each of the blades being a working surface and a non-working surface; each of the blades having an arcuate shape and comprising a radially inner end that is coupled to the lateral surface of the hub and a radially outer end, the working surface being a convex surface and the non-working surface being a concave surface;

wherein the base plate is divided into a plurality of sub-plates by the plurality of blades, each of the sub-plates is located between two adjacent blades and connected to the non-working surface of one of the two adjacent blades and the working surface of the other one of the two adjacent blades, and a distance from an edge of each of the sub-plates to a center of rotation of the impeller is varied, and the edge of each sub-plate has a wave shape and comprises a first curved surface, a second curved surface, and a third curved surface successively connected, the first and third curved surfaces are convex surfaces, and the second curved surface is a concave surface.

13. The pump according to claim 12, wherein a bottom surface of the base plate away from the hub includes a ring portion at a position under the hub.

14. The pump according to claim 12, wherein the distance from an edge of each of the sub-plates to the center of rotation of the impeller is gradually reduced and then gradually increased, along a circumferential direction starting from the non-working surface of one of the two adjacent blades toward the working surface of the other one of the two adjacent blades.

15. The pump according to claim 12, wherein each of the sub-plates defines a through hole therein.

* * * * *